United States Patent [19]

Fortunato et al.

[11] Patent Number: 5,011,159

[45] Date of Patent: Apr. 30, 1991

[54] METHOD OF PLAYING A CHESS GAME

[76] Inventors: Michael Fortunato; Michael A. Fortunato, both of 1659 Barbara Ct., East Meadow, N.Y. 11554

[21] Appl. No.: 465,976

[22] Filed: Jan. 16, 1990

[51] Int. Cl.[5] ..... A63F 3/02

[52] U.S. Cl. ..... 273/260; 273/280

[58] Field of Search ..... 273/239, 260, 262, 280

[56] References Cited

U.S. PATENT DOCUMENTS

| | | | |
|---|---|---|---|
| 1,374,139 | 4/1921 | Denniss | 273/280 |
| 3,093,919 | 6/1963 | Holtz | 273/239 |
| 3,794,326 | 2/1974 | Bialek | 273/260 |
| 4,373,731 | 2/1983 | Whiteman et al. | 273/262 |

FOREIGN PATENT DOCUMENTS

| | | | |
|---|---|---|---|
| 700150 | 12/1979 | U.S.S.R. | 273/260 |

*Primary Examiner*—Benjamin Layno

*Attorney, Agent, or Firm*—Michael I. Kroll

[57] ABSTRACT

A method of playing a board game combining chess, dice and money is disclosed. The game includes a chess board, marker pieces that have a specific value as a chessman and move on the chess board, and dice having a number corresponding to the value of the marker piece so that only the chessmen can move after the dice is thrown that correspond to the numbers on the thrown dice. Money is also included. Each chessman is assigned a monetary amount. When a player captures an opposing chessman, that player is rewarded the corresponding monetary amount. Monetary amounts are also rewarded to the players who are able to check an opposing king piece.

1 Claim, 2 Drawing Sheets

METHOD OF PLAYING A CHESS GAME

BACKGROUND OF THE INVENTION

1. Field of the Invention

The present invention relates to a chess game.

More particularly, the present invention relates to a chess game for at least one player and which uses dice.

2. Description of the Prior Art

As the experienced chess player already knows, chess is a wonderful game, perhaps the best two person game ever devised It is a universally liked game played the world over, by many people. People of all ages derive much pleasure from playing chess. Many books have been written about chess both for the amateur player and also for the advanced player of sophisticated and superior skill.

However, must the chess game always be a two person game? Why not be able to play a chess game all alone or with two or more players. Make it a party game!

It is not the applicant's intention to simply add another chess book to the long list already written, but rather a book describing a completely new way of playing chess that will delight the player with a new foolproof method of playing chess, as taught by the present invention. The applicant now adds one more book to the list of chess books by performing, for the first time ever, the marriage of chessmen with dice. Yes, chessmen with dice! The result is an entirely new game.

Numerous innovations for chess games have been provided in the prior art that are adapted to be used. Even though these innovations may be suitable for the specific individual purposes to which they address, they would not be suitable for the purposes of the present invention as heretofore described.

SUMMARY OF THE INVENTION

Accordingly, it is an object of the present invention to provide a method of playing a chess game for at least one player and which avoids the disadvantages of the prior art.

The present invention is a chess game played alone, with an opponent, or the ultimate game played with two to six players, all playing for their own gain.

No longer must a person need an opponent to play a game of chess. He can now play a sensible and orderly game all alone, if he so desires. It will surprise and delight the player to see how interesting the game of the present invention really is.

A learner of the game can play alone and not worry about making mistakes and looking foolish to an opponent. If a player likes to gamble, the player can get in with a group of friends and play the ultimate chess game where everyone plays for their own personal gain.

The experienced player of chess can skip over the instructions on chess for beginners, and go directly to the instructions dealing with the chess game of the present invention.

For beginners, it is necessary to first learn the basic game of chess so that the beginner can play any one of the three games of the present invention: solo di-chess, two man di-chess, and group di-chess.

The beginner has been given only the bare basics of chess play. However, the beginner should be able to play the game while he is still learning the basics. The beginner can improve in skill by simply playing the game of the present invention, and become more efficient the more he plays.

All penalties are necessary in order to keep enough money in the money pot or the money pot can become depleted, which can happen very easily.

Each player captures as many pieces of the opposing side as possible, for his own gain without regard for the outcome of the player's move of the other players of the same color following him. Each capture is a reward and is immediately taken out of the money pot and given to the player making the capture. Also, all penalties are immediately collected and put into the money pot, as they occur.

In keeping with these objects, and with others which will become apparent hereinafter, one feature of the present invention resides, briefly stated, in a game combining chess with dice, comprising a chess board, marker pieces having a specific value as a chessman and moving on the chess board and dice having a number corresponding to the value of the marker piece.

When the chess game for at least one player is designed in accordance with the present invention, the marker piece can move after the dice is thrown.

In accordance with another feature of the present invention, it further comprises money and at least one player.

Another feature of the present invention is that the chess board contains 64 squares.

Yet another feature of the present invention is that the 64 squares include 32 white squares and 32 black squares.

Still another feature of the present invention is that the money is kept in a money pot.

Yet still another feature of the present invention is that the marker pieces are 16 white marker pieces including one white king (K), one white queen (Q), two white rooks (R), two white bishops (B), two white knights (KN), and eight white pawns (P).

Still yet another feature of the present invention is that the marker pieces are 16 black marker pieces including one black king (K), one black queen (Q), two black rooks (R), two black bishops (B), two black knights (KN), and eight black pawns (P).

Another feature of the present invention is that the white queen must always be placed on a white square of the 32 white squares on the chess board.

Yet another feature of the present invention is that the black queen must be placed exactly opposite the white queen on a black square on the chess board.

Still another feature of the present invention is that the white king and the black king can each move in eight directions on the chess board, but only one square at a time.

Yet still another feature of the present invention is that the queen can capture any of the marker pieces in any of the boxes on the chess board.

Still yet another feature of the present invention is that the rook can move vertically or horizontally, but never diagonally.

Another feature of the present invention is that the bishop can move only diagonally.

Yet another feature of the present invention is that the knight can move only in an "L"-fashion and can jump over the marker pieces, the knight moving in two directions, vertically and horizontally, on one move.

Still another feature of the present invention is that the pawn can capture the marker pieces, one at a time, and that are only diagonally disposed to the pawn and not more than one box away.

Yet still another feature of the present invention is that it further comprises penalties and awards.

Still yet another feature of the present invention is that it further comprises a lazy susan for holding the chess board so that the at least one player can turn the chess board to himself to better be able to see the moves to make, a magnetized chess board for the purpose of holding the marker pieces firmly on the chess board, a round table is ideal, if possible, although not absolutely necessary; a dice tumbler for throwing the dice; and a timer for assuring that the game proceeds at a proper pace, the specific time limits would he for the at least one player to decide.

Another feature of the present invention is that the number tossed by the dice of which a chess move of the number tossed is still on the chess board and is not blocked and can be legally moved is referred to as "an indicated move".

Yet another feature of the present invention is that being checked from two different directions at the same time is referred to as "a double check".

Still another feature of the present invention is that it further comprises a money pot whose fee is five dollars per person per game.

Yet still another feature of the present invention is that the at least one player decides on how much time to allow to make a move s that the play is not prolonged too much to the detriment of the at least one player.

Still yet another feature of the present invention is that it further comprises a timer which is essential to the game in order to keep the game moving along at a reasonable pace.

The novel features which are considered characteristic for the invention are set forth in particular in the appended claims. The invention itself, however, both as to its construction and its method of operation, together with additional objects and advantages thereof, will be best understood from the following description of the specific embodiments when read in connection with the accompanying drawing.

DETAILED DESCRIPTION OF THE PREFERRED EMBODIMENT

Figure 1:
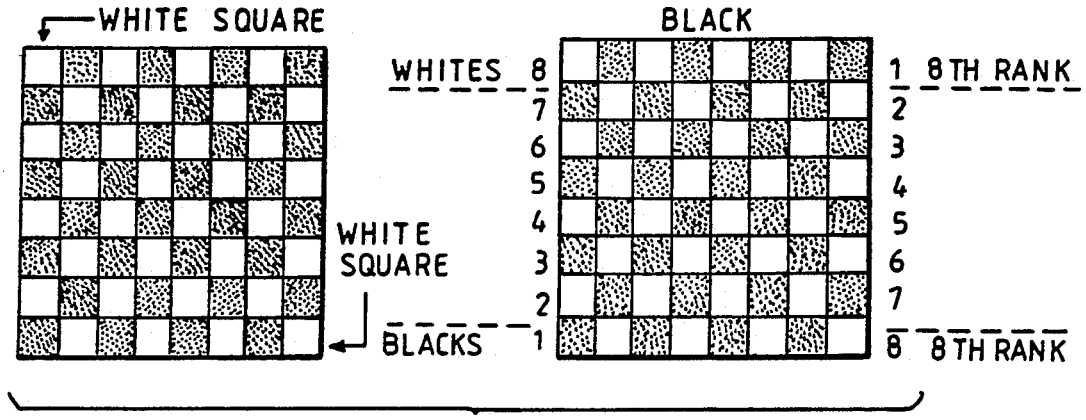
FIG. 1 is a plan view of the chess board having 64 squares of two colors, white squares and black squares.

In the basic chess for learners, the chessboard has 64 squares of two colors, 32 white squares and 32 black squares. The chessboard is positioned with a white square in the right hand corner nearest the player, as shown in FIG. 1.

The chessmen on white squares are disposed at the bottom of the chessboard, and always have the first move Each opposing side has sixteen game pieces. The sixteen game pieces are, a king (K), a queen (Q), 2 rooks (R), 2 bishops (B), 2 knights (KN), and 8 pawns (P). They are placed on the chessboard.

Figure 2:
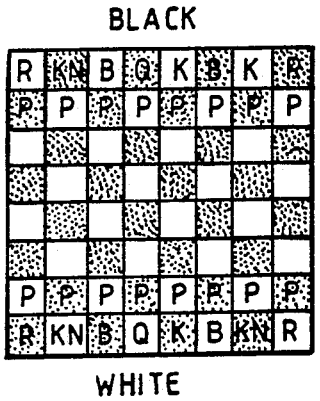
FIG. 2 is a plan view of the chess board on which the white queen must always be placed on a white square, and the opposing black queen must always be placed exactly opposite the white queen on a black square.

As shown in FIG. 2, the white queen must always be placed on a white square, and the opposing black queen must always be placed exactly opposite the white queen on a black square. Whites always play first.

Figure 3:
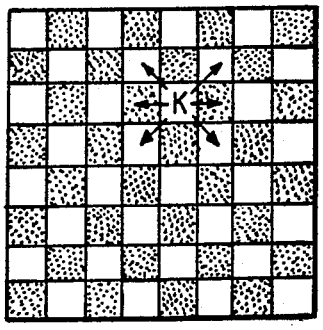
FIG. 3 is a plan view of the chess board on which is shown the eight directions in which the king can move.

The king moves in eight directions, as shown in FIG. 3. The king can only move one square at a time. However, the king can capture any enemy piece that is not more than one square away. However, the king may be blocked by his own pieces.

Figure 4:
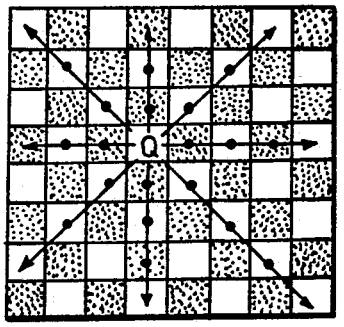
FIG. 4 s a plan view of the chess board on which is shown the queen being able to capture any piece in any box.

The queen is an extended version of the king. It too can move in eight directions. The queen can move to any box on the board making her the most powerful of all the pieces. However, the queen may be blocked by her own friendly pieces. She can capture any piece in any box, as shown in FIG. 4.

Figure 5:
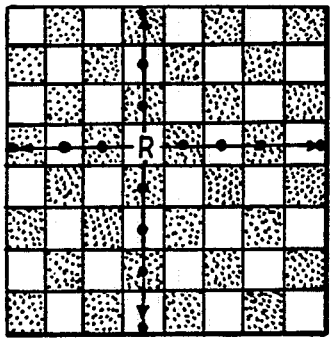
FIG. 5 is a plan view of the chess board on which is shown the rook being able to move all over the board.

The rook is the second most powerful piece in chess. He can move all over the board, as shown in FIG. 5.

The rook moves north to south, east to west, or vice versa. He can also be blocked by friendly pieces in his path. The rook can capture any piece as shown in FIG. 5 He can move vertically or horizontally, but never diagonally.

Figure 6:
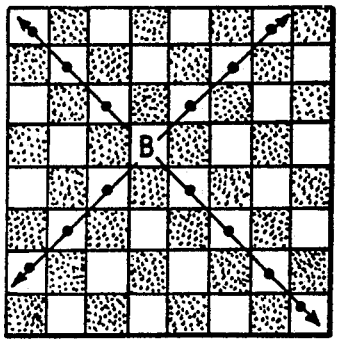
FIG. 6 is a plan view of the chess board on which is shown the bishop moving only diagonally.

The bishop can only move diagonally, as shown in FIG. 6. The bishop must always stay on the squares of the original starting color. The bishop can capture an enemy piece in any square that is diagonally disposed to his.

As can be seen, the bishop is a white square bishop, therefore, he can travel only diagonally along only white squares. Of course, there are also a black square bishop, which stays on black squares, and can travel only diagonally along only black squares, each side has a white square and a black square bishop.

Figure 7:
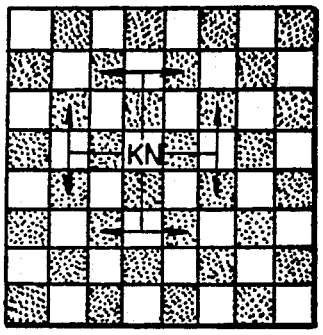
FIG. 7 is a plan view of the chess board on which is shown the knight moving only in an "L" fashion.

The knight can only move in an "L"-fashion as shown in FIG. 7. The knight is the only chessman who is not involved with obstructions in its way Furthermore, the knight is the only piece that can jump over friend and foe alike. It can move and capture any piece in the termination square of the "L"-fashion move, supra. It is the only piece that can move in two directions on one move, such as, vertically and horizontally as shown.

Figure 8:
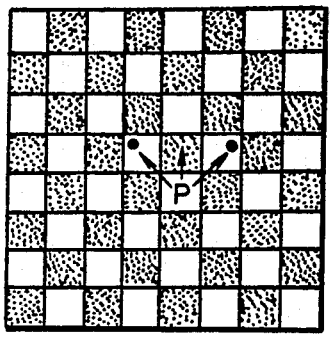
FIG. 8 is a plan view of the chess board on which is shown the pawn capturing only pieces that are diagonally disposed and not more than one square away.

The pawn moves straight ahead, only one square at a time, except on its first move where the pawn is allowed to move two squares. The pawn can be blocked by any chessmen in front of it. He must always move forward to the opposition. He can never move backwards. The pawn can only capture pieces diagonally disposed, as shown in FIG. 8. When a pawn reaches the eighth rank, he is promoted to anything he wants to be, except for a king. The pawn is replaced on the board by the piece he wishes to become.

It should be again noted that, with the exception of the knight which jumps over friend and foe alike, all the pieces of chess are blocked by their own pieces in their line of attack. They can not attack an enemy piece if there is a friendly piece between it and the piece it wants to capture. However, the knight has no obstructions in its path as it can jump over a piece to capture another piece, as long as it jumps in an "L"-fashion, as shown in FIG. 7.

Figure 9:
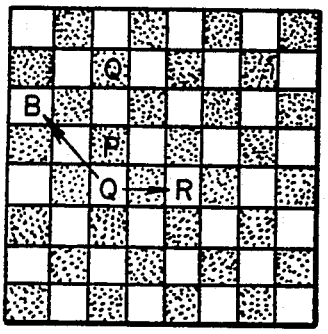
FIG. 9 is a plan view of the chess board on which is shown that the black queen can capture the white bishop or the white rook.

It is blacks move in FIG. 9, here the black queen can capture the white bishop or the white rook, but the black queen can not capture the white queen, as it is blocked by its own pawn.

Figure 10:
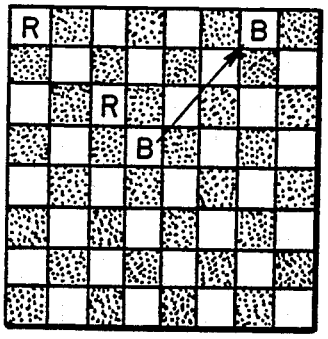
FIG. 10 is a plan view of the chess board on which is shown that the white bishop can capture the black bishop.

It is whites move, FIG. 10. The white bishop can capture the black bishop, but not the black rook, as the white bishop is blocked by its own white rook.

The end product of the chess game is to checkmate the opposing king. When this is done, the checkmated king loses the game. The king is in checkmate when he can not move out of the line of attack by an opposing piece, and no other piece can be placed between him and the attacking piece for protection. The king has no legal move to make.

Being checkmated or being in check, are two different things.

Figure 11:
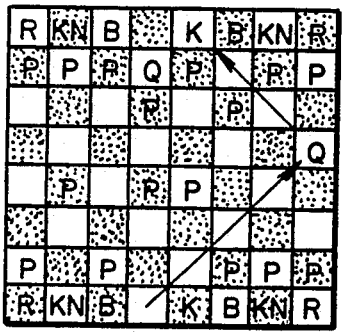
FIG. 11 is a plan view of the chess board on which is shown that the white queen has the black king in check.
Figure 12:
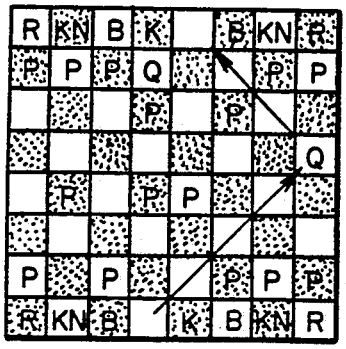
FIG. 12 is a plan view of the chess board on which is shown how the king can get out of check.

As shown in FIG. 11, the king is in check, In FIG. 12, it is shown how the king can get out of check, either by interposing a piece in front of him, or by his own move.

In FIG. 11, it is blacks move and the white queen has the black king in check. In FIG. 12, the king is out of check by simply moving to the square next to him, as shown.

Figure 13:
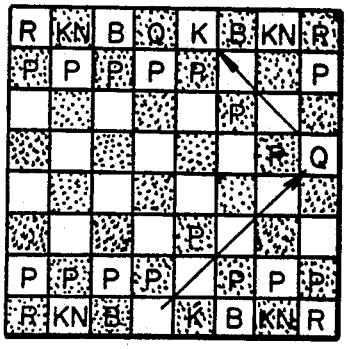
FIG. 13 is a plan view of the chess board on which is shown the king being checkmated.

In FIG 13, as can be seen, the king is unable to get out of check and he therefore becomes checkmated. A king can not be captured, only checkmated It is blacks move and the black king is in check by the white queen. The black king is surrounded by his own pieces and has nowhere to move, except to a square which will still keep him in check. Therefore, since the black king is unable to move, he is checkmated and the game is over.

Of course there are many other points to know in playing chess. A serious player can never stop learning. However, the learner is given the basics which will enable him to play an actual game to the end. With continued playing the beginner can learn all the other facets and tricks of the game. He will not become a chess master overnight, but he will be able to play sensibly and enjoy himself. With knowing just these basics, the beginner can play the chess game of the present invention.

A learner of chess should only play with people of equal ability and not with someone who is far ahead of him in skill.

The present invention was created mainly for the player who wants to play a sensible and orderly game of chess alone, either because of the lack of an opponent, or simply to practice to improve his skill. Naturally, a system had to be devised that would eliminate the players natural bias toward one color or the other and at the same time leaving the player with the option to move the chessmen in his own best interest.

First of all, the decision of which piece moves is taken out of the hands of the player, at least to a certain extent. What better way to do this than with a pair of dice. The player throws the dice alternately for each side, that is the black side and the white side. The dice tell the player which piece to move.

Each piece, according to its value as a chessman, has a corresponding number on the dice. Thus, the king would be #6, the queen would be #5, the rook would be #4, the bishop would be #3, the knight would be #2, and the pawn would be #1.

Two dice are used to throw for a number. The player may ask, "Why are two dice used and not one?" With two dice, the player is given more mobility with the chess pieces, and with two dice, the player is given more choices to play.

For example, if a 2 and a 3 are tossed, the player can play either the knight #2, the bishop #3, or the numbers 2 and 3 added together which is number #5, the queen. Of course, if the sum of the two dice is more than 6, the player has only two choices to play. The player can only play one choice at a time. The first toss must always be honored unless it is an illegal move.

With the choice of the piece to be moved, now settled, there is still the problem of making the best possible move without being biased for each side. This problem has been eliminated by making the player unaware of which side he is playing for, until the end of the game. To do this, a third dice is placed inside a box, shaken up, and put aside until the end of the game. At that time, the box is opened and if the dice shows an even number, the player has played for white and if an odd number is thrown, he as played for black.

Therefore, it is shown that with the method practiced by the present invention, the player makes the best possible moves for each side as he plays.

By not knowing which side the player is on, the player can not do otherwise. The method, supra, eliminated the possibility of bias toward either side. This method, of course, is only for the present invention using one player, as the other two games are played without the feature, supra.

In the present invention, using two dice that are in the box are not needed. This is the only difference between the first and the second embodiments of the game of the present invention. The player does not have much to say about which piece to move. However, the player does have the option to move the pieces in his own best interest for each side, as he plays.

Certain operational requirements have been formulated in order to play the sensible and orderly game of the present invention.

The tumbling of the dice did not always tell which piece to move. For example, at the beginning of the game, the only pieces that could move are the pawns and the knights, numbers 1 and 2, respectively, on the dice. All the other pieces are blocked from moving. Therefore, a 1 or 2 must be thrown in order to make the first move. Unfortunately, sometimes many throws of the dice are required before a 1 or 2 comes up. This prolongs the game and is therefore not in the best interest of the player.

Therefore operational requirement #2 includes 3 tosses. (to get a move). The dice are thrown up to 3 times, if necessary, to get an indicated move. If the player fails to get a move after 3 tosses, he is then entitled to a free hand move (henceforth referred to as F.H.M.). A F.H.M. simply means that a player can move any piece of his own choice, but subject to the free hand restrictions operational requirement.

However, at the beginning of the game, the move, supra, would be restricted to one of the pawns #1 or one of the knights #2, as all other pieces are blocked. As the game progresses, however, and more pieces become free to move, the player has a greater choice of pieces to move on a F.H.M..

Due to the nature of the game of the present invention, it was discovered that the king required more protection than in a conventional chess game. In the game of the present invention it was found that the king could be checked or checkmated much more easily than in conventional chess play. The toss of the dice could go against the player repeatedly. The player can not move out of harms way all by himself, as he could do in conventional chess. The king has to wait for favorable throws of the dice to get out of harms way.

It must be noted that in this new type of play of the present invention, the dice will put a player in positions the player would never have gone to in conventional chess play. Also a piece whose number is tossed on the dice must move if he can legally. Therefore, a king may frequently move to a square that would put him in the line of attack of the opposing side, on the opposing sides next tosses. The king can not move into a check position. If, however, he is ordered to do so by the dice, he must ignore it and simply stay where he is. The play simply goes on to the next player. Therefore, if a king is in check, he must move out of check by the toss of his number 6, or by a combination of numbers adding to 6, or a number that can be interposed in the line of attack, and thus block the threat. Therefore, to prevent the game from ending too soon, the king's operational requirement has been revised.

When a king is put in check he shall be given 3 tosses of the dice in order to get out of check. Failing to get his number or an interposing number after 3 tosses, he is then considered checkmated (even though he is not really checkmated) by the game of the present invention and the game is over.

In the Di-Chess group of the present invention, there is no king's operational requirement, and therefore not applying to the king in check. The object of this game is the quick checkmate of the opposing king, in group Di-Chess the king is only allowed 1 toss. Failing to get out of check is not climatic for the king. The game of the present invention simply goes on to the next player, of his color, who tries to get the king out of check. Each player, failing to free the king, is penalized accordingly. Every time a player frees his king from check, he is rewarded accordingly. These operational requirements apply only to group Di-Chess.

The Solo Di-Chess player must realize that unlike regular chess, the pieces can only move when their numbers are tossed. Therefore, the strategy of play is quite different in the present invention than in conventional chess play. After playing a few games, the player will identify the differences and play accordingly. The player must constantly guard himself against exposed capture. This occurs when a piece suddenly becomes exposed to being captured. Because of the previous move, will the kings next toss let him escape capture or become captured?

At this point it is worth repeating that the exposed piece must wait for his number to be tossed again, in order to get out of danger, or another piece brought into play to protect him.

In the present invention, one can't just raid the enemy's territory, capture a piece, and then hope that a retreat is possible before the piece is put into danger of being captured. Favorable tosses may not be for quite awhile.

In the meantime, the opponent may get all good tosses, and surround, and capture the opponent. The present invention is really quite a different and interesting new way of playing chess. In this game, one has to depend a lot on taking or not taking chances with the tossing of the dice.

It would be nice if a player tosses the number needed, whenever desired. Taking chances or gambling on the tosses inherently becomes the main purpose of the game of the present invention.

The playing of solo Di-Chess and two man Di-Chess are done in the same basic manner. The dice in the box is not needed. Group Di-Chess is the third and ultimate Di-Chess game of the present invention.

In group Di-Chess, each player plays solely for the player's own gain, regardless of any other player who is playing the same color and on the same side as the other player is. His only concern is to capture as many pieces as possible As each capture pays off according to its value as a chessman. Each player plays in a rotational set at the start of each game. Each new game is started by the next player in rotation, and so on.

The white pieces always play first. Therefore, each player will play a different colored team as the games of the present invention are played. This method is used in order to let every player have a turn at being first and also to allow each player to play both colors. Of course, this will only be applicable if the game has an even number of players. Should a player leave the game, and no one is found to take his place, then the players will play a different color each time their turn comes. This is perfectly valid because it makes no difference which side the players are on.

Version three of the game of the present invention captures pieces for a reward. It makes no difference which color they are. Of course, if someone is found to fill the vacancy, immediately, then all the players will play their same color for the entire game. The rotation of the players is set at the beginning of each game. This rotation is kept for all the games so that a different player will start each new game.

The distinctive features of the group Di-Chess game, version three of the present invention are as follows:

There is only one toss of the dice needed for a player to move its piece;

There is no free hand move;

There is no king's operational requirement;

There are penalties and rewards;

Two to six players can play for their own individual gain;

The players can leave the game while it is in progress; and

The players can enter the game while it is in progress.

A list of equipment recommended for playing the Group Di-Chess game, version three of the present invention is as follows:

A lazy Susan for holding the chess board so that each player can face the board to himself to better be able to see the moves to make;

A magnetized chess board for the purpose of holding the pieces firmly on the board A round table is ideal, if possible, although not absolutely necessary;

A dice tumbler because throwing the dice could present a problem; and

A timer for assuring that the game proceeds at a proper pace. The specific time limits would be for the players to decide.

The chess games of the present invention require that the following criteria be observed, for maximum enjoyment:

1. All the operational requirements of regular chess apply in all three types of Di-Chess games. Each game, however, has its own few exception.

2. In Solo Di-Chess and two man Di-Chess, up to three tosses of the dice is allowed in order to get an "indicated move". When the dice are tossed, if a chess man of the tossed dice number is still on the board, and is not blocked, he can be legally moved according to the operational requirements of conventional chess, and being called an "indicated move". The first "indicated move" must be honored, and unless the king's operational requirement is being played, it must be honored. However, after three tosses and the player fails to get a move, he is then entitled to an F.H.M.

3. This operational requirement applies only to Solo Di-Chess and two man Di-Chess. After three tosses, the dice fail to give a move, the player then gets to move any piece of his own choice, but subject to the F.H.M. restrictions operational requirement.

4. The player can move any piece of his choice but he can't capture, check, or checkmate, unless it is the only legal move which can be made. A free hand cannot be used to get a king out of check, either. A move must always be made. A player cannot let his turn pass without having moved a piece, if he could. Since a F.H.M. is not a prime move or a legitimate indicated toss move, the player should not he given the privilege of capturing, checking, checkmating, or moving a king out of check, as this would diminish the value of legitimate prime toss.

5. When a king is in check, he is given three tosses to get out of check. Failing in three tosses to do so, he is considered checkmated and the game is over, even if he is not actually checkmated. The king must ignore the first "indicated move" operational requirement and toss until he gets a favorable number that will allow him to get out of check. A F.H.M. is never allowed at an time for the king.

6. An "indicated move" is the number tossed by the dice of which a chess man of that number is still on the board, and is not blocked, and can be legally moved. The player must always honor the first "indicated move" he tosses, except if the king's operational requirement is being played. He must always do this as long as it is a legal move.

7. A king cannot be checked consecutively by the same piece from the same square if it has not moved from that square after the first check call. However, the king can be checked by the same piece, if his number is tossed a second straight time by the opposing side and with the piece advancing toward him or even away from him in the same line of attack, or any other square that still has the king in check.

Every check call can only follow the actual moving of the piece that put the king in check to begin with. When a player's turn comes, he can not just look at the chess board, and see a check situation already on the board and call check. He must make a move in order to call check. A king can also be checked consecutively if every check call were made from a different direction. This is perfectly alright as long as it is never by the same piece from the same square.

8. Any mistake in the playing of the game of the present invention, realized after it has been made, must be corrected immediately, unless another move, after the mistake, has already been made. If so, then the game simply goes on as though nothing had happened. All the chessmen remain where they are. The mistake has to be caught in time before the next move is made in order to be corrected. There is no penalty for anyone caught making a mistake.

9. In Solo Di-Chess the dice in the box is used so that the game could be played. The dice are indispensable as the whole game is based solely on the throw of the dice. Therefore, great care must be taken in assuring that the box is not jarred when opening it to reveal which color is uppermost on the dice. The player has played for that color, whichever it is.

10. A piece is moved which puts a king in check and reveals the discovered check is called "a double check". "A double check" is being checked from two directions at the same time. The piece that was moved, is the only one that can call check. The discovered check piece can not call check on the next players turn because he did not move him to that spot, the chess piece was already there in the discovered spot. In other words, when a player's turn comes, he can not just look at the chess board, see a check situation, not move a piece, and simply call check. He must make a move in order to call check. He must move into a check spot to call check, if available.

The operational requirements 12, 16, and 17 are for Solo and Two Man and are the same as 12, 16, and 17 in Group Di-Chess.

This concludes all the operational requirements for Solo and Two-Man Di-Chess.

If the operational requirement applies to all three types of games in the exact same way, then each type of game of the present invention will have the same number for all three types of games.

If a number is followed by the letter (A), it means that the operational requirement pertains to the same subject, but is slightly different. In Solo, operational requirement (2), which requires three tosses to make a move, would be operational requirement 2A. For Group Di-Chess, the group allows only one toss to make a move. In Solo operational requirement 5, the king is given three tosses to get out of check, but in Group Di-Chess, he is only given one toss to get out of check. Therefore, the operational requirement number is 5A for Group Di-Chess.

1. The operational requirements of regular chess apply in all three types of Di-Chess games, along with the additional operational requirements created for the three new games. Each game may have exceptions to certain operational requirements. For example, captures in regular chess are optional, as in Solo and Two Man Di-Chess. In Group Di-Chess, however, captures are mandatory, unless, of course, they are illegal. The games could not have been created without certain new operational requirements becoming a part and regulations of the game. It is an exiting new way of playing a wonderful old game.

2A. In Group Di-Chess there is only one toss of the dice allowed and there is no F.H.M. Failure to get a move is a penalty Three choices of play on a toss is allowed, as in the other two games. The king need not worry about being left in check as it is not climactic for him in this game. A player failing to get out of check is simply penalized, and the game goes on. It is then up to the next player, on the same side, to get the king cut of check.

3A. Failure to get a move after one toss is a penalty. The game needs a constant cash flow to keep it going.

4A. With no F.H.M. in the game, there are no F.H.M. restrictions.

5A. Unlike Solo and Opponent Di-Chess, the king in Group Di-Chess is not given three tosses of the dice to get out of check. That would defeat the main purpose of the game, which is mainly for each player to make as much money as possible and to checkmate the king as quickly as possible. A king in check is a step or two away from being checkmated, which is desirable in this type of game.

It is obvious that the tosses would all have to he the right moves for the checking side of this to occur so quickly. Therefore, to make a faster moving game, the player is only given one toss of the dice. Should that fail it would not be climactic for him, it will simply be left up to the next player of the same side to get the king out of check. Each player who fails to get the king out of check is penalized according to the operational requirements of the particular game of the present invention.

This game cannot end with a king being simply in check, as in Solo or Two Man chess, where the player's three tosses must get him out of check or the game is over. In this game of Group Chess, the king must actually he checkmated, stalemated, or drawn to end the game.

Therefore, the players side of the king in check, must in their turn try to get the king out of check as quickly as possible.

They must let everything else go and concentrate on this fact only. Of course, a player may get a toss that would allow him to capture a piece, but not get his king out of check. A player can do this, but he would be penalized for not getting his king out of check. Therefore, the player is both rewarded, captured, and penalized on the same move. However, should a player toss a number that gives him a choice of either getting his king out of check or capturing a piece, then he must get his king out of check and forego the capturing of the piece.

The king being in check is of paramount importance and can't be left in check if he can be gotten out of check. In this game of moving only the piece that the dice tell you to move, the king can be in check for quite a few tosses before he is rescued. But, that is the nature of the game and is normal. The players must not forget that when the king is in check, the next toss of the side checking him may be the checkmate which is what every player is trying to do.

6A. In Group Di-Chess, there is only one toss allowed and therefore every toss, either indicated or not, must be played, if it can legally be played.

7. A king cannot be checked consecutively by the same opposing piece from the sam square, if the king has not moved from that square after the first check call. However, the king can be checked by the same piece, if his number is tossed a second straight time, if the piece were to advance toward him or away from him in the same line of attack, or any other square that would still have the king in check Every check call can only follow the actual moving of the piece that put the king in check. When a player's turn comes, he cannot just look at the chess hoard, see a check situation already on the board and call check. He must make a move in order to call check. A king can also be checked consecutively if every check call were made by a different piece from a different direction. This is legal, but never by the same piece from the same square.

8. This operational requirement is the same as the operational requirement for Solo and Two Man Di-Chess.

9A. Dice in box, does not apply

10. This operational requirement is identical to the operational requirement for Solo and for Two Man Di-Chess.

11. Should a player toss a number which is no longer on the chess board, he will not be penalized. The player does not get another toss. The play simply goes on to the next player.

12. A player can never pass up his turn at play. Every player must make a move if he can legally do so. If he has no legal move to make, he is not penalized, the play simply goes on to the next player. But, if a person has a legal move and fails to make it before time runs out, he is then penalized according to the operational requirements of the game.

13. Unlike Solo and Two Man Di-Chess, captures in group chess are mandatory The faster the chess board opens up to all movement through mandatory captures, the better it is for all the players involved. The game will move faster which is desirable to everyone.

14. Rewards and penalties is what group Di-Chess is all about. The game revolves around the individual gain of each player. There are plenty of rewards and some penalties. Rewards or penalties are immediately taken out of or put in to the money pot, as they occur.

15. A timer is essential in this game in order to keep the game of the present invention moving along at a reasonable pace. The time limit is set by the players at the beginning of the game. A penalty is given for exceeding the time limit set.

16. All games are played to a conclusion of check mate, stalemate, draw, or any other legitimate name, as in regular chess. In a checkmate, there is only one winner, but in all the other games the remaining money is shared equally among all the players.

17. It is understood that all players must abide by all the operational requirements of the new way of playing chess.

This concludes all of the operational requirements of the game of the present invention. They are fixed and set and can not be changed.

The following operational requirements are for conducting the playing of all three types of games. These operational requirements are not set in stone. They are flexible and can be altered according to the will of the majority of the players involved.

EXAMPLE

On the early leave penalty requirement, the players may decide to do away with the penalty for that particular game.

A. The kitty or money pot fee is determined first. A fee of five dollars per person is recommended and is put into the kitty at the start of the game. All rewards and penalties are a percentage of this money pot fee.

B. Before a game can start, the players, from 2 to 6, must choose a rotation of the players and also who is the first to play. Each succeeding game is started by the next player in rotation. All games should be started with an equal amount of players, but this is not absolutely necessary with an equal amount of players, everyone plays the same color for the entire game. With an odd amount of players, everyone will play a different color, as the player's turn comes around. This makes no differences actually since the object of the game is simply to capture pieces, and it makes no difference which color the player captures.

C. The players decide on how much time to allow to make a move. A small penalty is given anyone who exceeds the time limit. The game would not be conducted properly without this feature. The play could obviously be prolonged too much, to the detriment of all the players.

D. Every new game started requires a new entry fee. The players may all decide on a different amount for the entry fee, and they are free to do so.

E. The percentages of the rewards and penalties that are set down should not be changed. All the reward and penalty amounts are a percentage of the entry fee, and were carefully arrived at as being the best of percentages. They were designed to keep enough money in the money pot for the players as they win. As there would not be any reason for playing if the money pot were depleted too soon.

F. All players must play solely for their own individual gain, regardless of the outcome of their play on anyone of the same side, following them.

G. A player wanting to leave the game while it is still in progress must pay a penalty, unless he can find a person to take his place. However, if a player has a good reason for leaving, such as a sudden illness, or if the player is called away suddenly, or any other good reason, the player is not penalized. The penalty is 20% of the entry fee.

H. A person may enter a game while it is still in progress. If there is a vacant chair due to a sudden departure, the player must pay the regular entry fee like everyone else did, unless the player is a replacement for someone leaving for a good reason, in which case the player is not required to pay a fee since he is entering on the exiting person's fee.

I. At the end of all the games should anyone wish to leave the game and not play anymore is allowed to leave. The player must be given his share of any pot money remaining in the kitty, before any new fees for the next game are put in.

J. If at any time during the playing of the game, the kitty money runs out, which can happen, the players must all put into the kitty an additional agreed upon amount of money so as to keep the game going to its end. Without money in the money pot, there is no reason to keep playing. Also, it may happen that a player wins an amount that is more than what is in the money pot. This should also be corrected with an additional amount from all the players. All money that is left in the money pot due to a game ending for other than checkmate, is shared equally by all the players. A new fee of $5.00 is put in by all players for the following game.

K. All players of Group Di-Chess should know how to play the basic game of chess. If there are players who do not know how to play the basic game of chess, the players themselves must decide on just what degree of knowledge each player should have. However, amongst friends they may decide to be liberal and become teachers of how the game of the present invention is played.

It will be understood that each of the elements described above, or two or more together, may also find a useful application in other types of constructions differing from the type described above.

While the invention has been illustrated and described as embodied in a chess game for at least one player, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

A - Operational Requirement Comparison Chart

| SOLO | TWO-MAN (OPPONENT) | GROUP (2 TO 6 PLAYERS) |
|---|---|---|
| All regular operational requirements of chess apply in all three games | same | same |
| Three toss operational requirement to get a move | same | one toss only to get a move |
| F.H.M. after three tosses fail | same | No F.H.M. |
| F.H.M. restrictions apply | same | does not apply |
| Three tosses to get out of check | same | one toss only to get out of check |
| First indicated move must be honored (legally) | same | no indicated move operational requirement |
| Consecutive check operational requirement (not allowed) | same | same (not allowed) |
| Mistake operational requirement applies | same | same |
| Dice in box used | optional | does not apply |
| Discovered check, not allowed to check | same | same |
| No dead man toss operational requirement | same | has dead man toss operational requirement |
| Player can not pass up turn | same | same |
| Captures are optional | same | captures are mandatory |
| Has no rewards or penalties | same | has rewards and penalties |
| Timer optional | same | timer mandatory |
| Games played to a conclusion | same | same |
| Players must abide by the | same | same |

-continued

| A - Operational Requirement Comparison Chart | | |
|---|---|---|
| SOLO | TWO-MAN (OPPO-NENT) | GROUP (2 TO 6 PLAYERS) |
| operational requirements | | |

| ABBREVIATED TERMS | |
|---|---|
| I.M.T. | Indicated move toss |
| 1ST I.M.T. | First indicated move toss |
| F.H.M. | Free hand move |
| F.H.M. RES. | Free hand move restrictions |
| C.C.R. | Consecutive check operational requirement |
| D.C.R. | Discovered check operational requirement |
| D.M.T. | Dead man toss operational requirement |
| G.PL.R. | Game play operational requirement |
| G.PR.R. | Game procedure operational requirement |
| R.C.R. | Regular chess operational requirement |

| COMPARISON CHART | | | |
|---|---|---|---|
| | SOLO | TWO-MAN (OPPO-NENT) | GROUP (2 TO 6 PLAYERS) |
| Can check | yes | yes | yes |
| Can mate | yes | yes | yes |
| Can capture | yes | yes | yes |
| Capture king | no | no | no |
| Tosses to get out of check | 3 | 3 | 1 |
| Tosses to get move | 3 | 3 | 1 |
| F.H.M. | yes | yes | no |
| Rescue failure penalty | no | no | yes |
| Entrance Fee | no | no | yes |
| Rewards | no | no | yes |
| Other penalties | no | no | yes |
| F.H.M.for King | no | no | no |
| Use dice in box | yes | optional | no |
| Captures are Optional | yes | yes | no |
| No capture move penalty | no | no | yes |
| No move toss penalty | no | no | yes |
| Timer penalty | no | optional | yes |

CAPTURES

| CAPTURES | | | |
|---|---|---|---|
| VALUE OF CHESS MEN WHICH IS ALSO THEIR NUMBER ON THE DICE | | 50% OF ENTRY FEE | PLAYER CAPTURES AND GETS REWARD |
| King is 6 | can't capture | — | — |
| Queen is 5 | x | $2.50 | $12.50 |
| Rook is 4 | x | $2.50 | $10.00 |
| Bishop is 3 | x | $2.50 | $7.50 |
| Knight is 2 | x | $2.50 | $5.00 |
| Pawn is 1 | x | $2.50 | $2.50 |

OTHER REWARDS

Check mate of king wins whole money pot.
Promotion to queen wins $10.00
King put in check wins $5.00
Get King out of check wins $5.00

PENALTIES

Failure to get king out of check loses $1.00.
No move toss loses $1.00.
No capture move loses $1.00.
Exceed time limit loses $1.00.

SUGGESTED SCHEDULE OF FEES, PENALTIES, AND REWARDS

| | |
|---|---|
| Entry fee at start of game | $5.00 |
| Entry into game in progress | $5.00 |
| Replacement for player | No charge |

PENALTIES

| | |
|---|---|
| No move toss | $1.00 |
| No capture move | $1.00 |
| Fail to rescue king | $1.00 |
| Exceed time limit | $1.00 |

REWARDS

| | |
|---|---|
| Put king in check | $5.00 |
| Get king out of check | $5.00 |
| Checkmate of king | whole money pot |
| Promoting a pawn to queen | $10.00 |

CAPTURES AND REWARDS

All captures of chess men are rewards and are paid according to the value of the chess man captured. The percentages are the same for all chess men.

| The chess mans number × 50% of the entry fee ($2.50) | | | |
|---|---|---|---|
| Capture of the queen is | 5 × $2.50 | or | $12.50 |
| Capture of the rook is | 4 × $2.50 | or | $10.00 |
| Capture of the bishop is | 3 × $2.50 | or | $7.50 |
| Capture of the knight is | 2 × $2.50 | or | $5.00 |
| Capture of the pawn is | 1 × $2.50 | or | $2.50 |

I claim:

1. A method of playing a board game comprising the steps of:

providing a game board having a grid of spaces on the surface thereon;

providing a plurality of playing pieces, said piece divided into two opposing sets, each set of pieces having distinguishing means thereon to visually distinguish one set of pieces from the opposing set pieces, each set of pieces having six differently configured playing pieces;

providing a conventional pair of six-sided dice, the faces of each die having a number from 1 to 6;

providing money in a money pot;

assigning a different predetermined movement capability to each of the six differently configured pieces;

assigning a number on a die face to a differently configured piece, wherein each number on a die corresponds to a differently configured piece; assigning one of the differently configured pieces of each set as the superior piece;

assigning a set of pieces to each player;

placing the pieces on the board;

each player in turn rolling the dice, moving two pieces which correspond to the two numbers appearing one the dice, wherein movement is limited to the assigned movement capability;

capturing an opposing piece when a piece lands on a space occupied by said opposing piece;

providing an objective to the game wherein players move their pieces to a position wherein the opposing superior piece is held in check or capable of being captured upon the next move of the pieces;

assigning a different monetary amount to each of the six different pieces, wherein when a player capture an opposing piece, that player is rewarded the corresponding monetary amount from the money pot;

rewarding a player a monetary amount from the money pot whenever his/her pieces are positioned to hold an opposing superior piece in check;

penalizing a player by requiring the player to place a predetermined amount of his/her own money in the money pot every turn his/her playing pieces are unable to move or unable to capture an opposing playing piece;

penalizing a player by requiring the player to place a predetermined amount of his/her own money in the money pot every turn his/her superior piece is unable to get out of check.

* * * * *